US006669324B1

(12) United States Patent
King et al.

(10) Patent No.: US 6,669,324 B1
(45) Date of Patent: Dec. 30, 2003

(54) METHOD AND APPARATUS FOR OPTIMIZING A RELATIONSHIP BETWEEN FIRE ENERGY AND DROP VELOCITY IN AN IMAGING DEVICE

(75) Inventors: David G. King, Shelbyville, KY (US); Carrie A. Klusek, Lexington, KY (US); Patrick L. Kroger, Versailles, KY (US); Kent L. Ubellacker, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/304,148

(22) Filed: Nov. 25, 2002

(51) Int. Cl.[7] ..... B41J 29/393
(52) U.S. Cl. ..... 347/19; 347/14
(58) Field of Search ..... 347/14, 19

(56) References Cited

U.S. PATENT DOCUMENTS

| | | | | |
|---|---|---|---|---|
| 4,686,539 A | | 8/1987 | Schmidle et al. | |
| 4,872,028 A | * | 10/1989 | Lloyd | 347/19 |
| 5,109,234 A | | 4/1992 | Otis, Jr. et al. | |
| 5,428,376 A | | 6/1995 | Wade et al. | |
| 5,526,027 A | | 6/1996 | Wade et al. | |
| 5,642,142 A | | 6/1997 | Bohorquez | |
| 5,682,185 A | | 10/1997 | Wade et al. | |
| 5,751,302 A | | 5/1998 | Rezanka | |
| 5,886,716 A | | 3/1999 | Heinzl et al. | |
| 5,997,124 A | * | 12/1999 | Capps et al. | 347/14 |
| 6,076,981 A | | 6/2000 | Hayama et al. | |
| 6,116,717 A | * | 9/2000 | Anderson et al. | 347/19 |
| 6,151,050 A | | 11/2000 | Hosono et al. | |
| 6,183,056 B1 | | 2/2001 | Corrigan et al. | |
| 6,244,682 B1 | | 6/2001 | Walker et al. | |
| 6,467,867 B1 | * | 10/2002 | Worthington et al. | 347/19 |
| 2002/0030708 A1 | * | 3/2002 | Yoshida | 347/19 |

* cited by examiner

*Primary Examiner*—Stephen D. Meier
*Assistant Examiner*—Julian D. Huffman
(74) *Attorney, Agent, or Firm*—Taylor & Aust, P.C.; Scott N. Barker, Esq.

(57) ABSTRACT

A method of optimizing a relationship between fire energy and drop velocity associated with a printhead is provided. A test pattern is printed by selectively supplying energy distribution signals to a plurality of actuators of the printhead. The energy distribution signals have distinct energy profiles. The test pattern is scanned to obtain drop velocity information corresponding to the energy distribution signals. Based on the drop velocity information, an energy profile is determined that optimizes the relationship between fire energy and drop velocity.

23 Claims, 7 Drawing Sheets

METHOD AND APPARATUS FOR OPTIMIZING A RELATIONSHIP BETWEEN FIRE ENERGY AND DROP VELOCITY IN AN IMAGING DEVICE

BACKGROUND OF THE INVENTION

1. Field of the Invention

The present invention relates to a method and apparatus for optimizing a relationship between fire energy and drop velocity in an imaging device, and, more particularly, in one embodiment, to a method and apparatus for adjusting pre-fire and fire pulses used to jet ink from a printhead in an imaging device.

2. Description of the Related Art

An ink jet printer typically includes a printhead, which is carried by a carrier. The printhead is fluidly coupled to an ink supply. Such a printhead includes a plurality of nozzles having corresponding ink ejection actuators, such as heater elements.

Ink is jetted from the nozzles onto a print medium at selected ink dot locations within an image area. The carrier moves the printhead across the print medium in a scan direction while the ink dots are jetted onto selected pixel locations within a given raster line. Between passes of the printhead, the print medium is advanced a predetermined distance and the printhead is again moved across the print medium.

Ink jet printers may utilize a single printhead, or multiple printheads. For example, some ink jet printing systems utilize a monochrome ink cartridge including a monochrome, e.g. black, printhead, and a color ink cartridge including a color printhead having cyan, magenta and yellow nozzle groups. In another type of ink jet printing system, each printhead is connected to a respective remote ink supply.

The manufacture of printheads involves certain manufacturing tolerances resulting in manufacturing variations (e.g., variations in sheet resistance of the material used in heater elements; mask alignment variations, which lead to variations in the width and length of heater elements; the rise and fall times of transistors that drive the heater elements; the thickness of the layer between the heater element and the ink, which influences heat transfer to the ink; the ink chemistry; and the voltage level of the power source), which in turn result in printheads that require differing amounts of energy to attain a drop velocity deemed suitable (e.g., high enough) for attaining a desired print quality. Thus, typically, from printhead to printhead, the amount of energy required to attain a suitable drop velocity varies.

Because of these manufacturing variations, an energy level for driving such printheads will be selected so that most printheads will attain a certain minimum drop velocity (e.g., 400–600 inches per second). This energy level is a statistical average value meant to encompass the largest range of printhead variations possible. Because the same predetermined amount of energy is used for each printhead, the energy is not optimized for a particular printhead.

One problem with this manner of ink delivery is that variations in the printheads lead to inefficiencies in printhead operation. The result is drop velocity variations and difficulty in maintaining nominal head temperatures. Another problem is that driving ink jet heaters at an energy level required to jet ink at an acceptable drop velocity means overdriving some printheads. By overdriving printheads, the overdriven nozzles can fail prematurely due to electromigration of the heater element.

What is needed in the art is a method and apparatus that reduces variations in drop velocities among a type of printhead, and/or provides for fire energy adjustment for the printhead.

SUMMARY OF THE INVENTION

The present invention provides, in one embodiment, an apparatus and method for measuring ink drop velocities and adjusting the energy used to eject ink.

The invention, in one form thereof, is directed to a method of adjusting fire energy supplied to an actuator of a printhead of an ink jet printer. The method includes printing a test pattern on a print media by selectively supplying energy distribution signals to a plurality of actuators of the printhead, the energy distribution signals having distinct energy profiles; scanning the test pattern to obtain offset values, each of the offset values representative of a distance between at least two corresponding portions of the test patterns; calculating drop velocities from the offset values; and selecting from the energy distribution signals an energy distribution signal that corresponds with an optimal one of the drop velocities.

The invention, in another form thereof, is directed to an ink jet printer. The ink jet printer includes a controller, a sensor and a printhead having actuators that are capable of jetting ink with a drop velocity when an energy distribution signal having a fire energy is supplied. The controller is capable of communicating with the printhead and the sensor. The controller employs a method including printing a test pattern on a print media by selectively supplying energy distribution signals to a plurality of the actuators of the printhead, the energy distribution signals having distinct energy profiles; scanning the test pattern with the sensor to obtain offset values, each of the offset values representative of a distance between at least two corresponding portions of the test pattern; calculating drop velocities from the offset values; and selecting from the energy distribution signals an energy distribution signal that corresponds with an optimal one of the drop velocities.

The invention, in yet another form thereof, is directed to an imaging device including a carrier, a printhead carrier by the carrier, a sensor carried by the carrier, and a controller communicatively coupled with the printhead and the sensor. The controller is configured to print an image on a sheet of print media. The image includes a test pattern. The controller employs an energy distribution signal adjustment method to determine an energy profile for the printhead.

The aforementioned energy distribution signal adjustment method includes printing the test pattern using distinct energy profiles; scanning the test pattern with the sensor to obtain offset values, wherein a respective one of the offset values is representative of a distance between corresponding portions of the test pattern; and calculating drop velocities corresponding to the distinct energy profiles based on the offset values; Based on the drop velocities, an optimal energy profile is determined. The optimal energy profile is determined by using the drop velocities to determine when an incremental change in energy corresponds with a disproportionate change in drop velocity.

The invention, in yet another form thereof, is directed to a method of optimizing an energy distribution signal for use by a printhead including a plurality of heater elements. The method includes printing a test pattern using energy profiles; scanning the test pattern to obtain offset values, wherein a respective one of the offset values is representative of a distance between corresponding portions of the test pattern; and calculating drop velocities corresponding to the energy profiles, wherein the optimal energy profile is determined by using the drop velocities to determine when an incremental change in energy corresponds with a disproportionate change in drop velocity. An energy distribution signal corresponding to the optimal energy profile is selected.

The invention, in still a further form thereof, is directed to a method of optimizing a relationship between fire energy and drop velocity. In such a method, a test pattern is printed by selectively supplying energy distribution signals to a plurality of actuators of a printhead. The energy distribution signals have distinct energy profiles. The test pattern is scanned to obtain drop velocity information corresponding to the energy distribution signals. Based on the drop velocity information, an energy profile is determined that optimizes the relationship between fire energy and drop velocity.

An advantage of certain embodiments of the present invention is that the fire energy used in an ink jet printer printhead is optimized thereby increasing the life of the printhead.

Another advantage of certain embodiments of the present invention is that the printhead heats less; thus, throughput levels of the printer can increase since the time required to cool a printhead is reduced or eliminated.

Still yet another advantage of certain embodiments of the present invention results from allowing thin film printheads to run open loop without any temperature sensor resistor being required.

A further advantage of certain embodiments of the present invention is that variations that occur in the manufacture of the printhead can be compensated.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
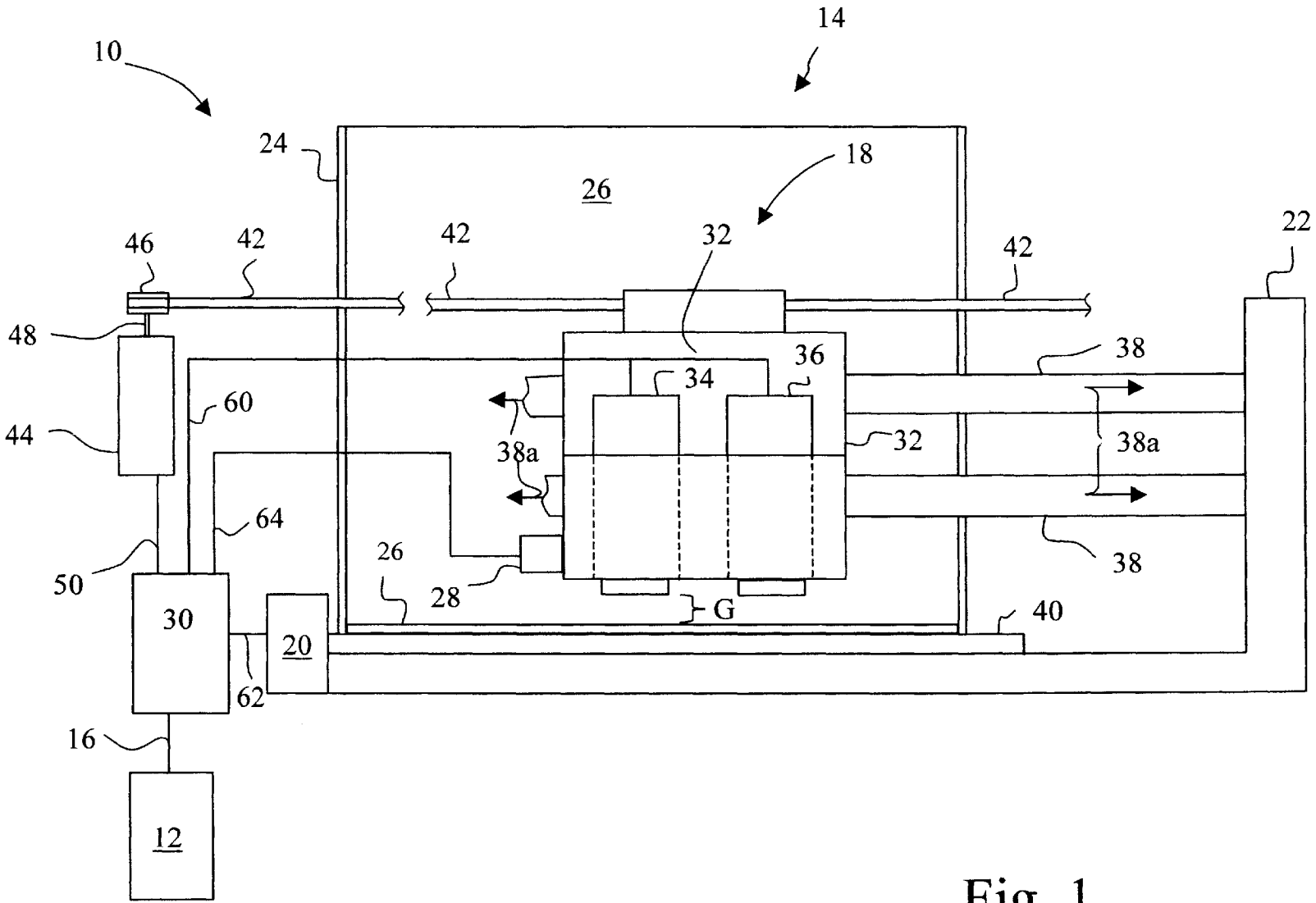
FIG. 1 is diagrammatic representation of an imaging system employing an embodiment of the method of the present invention.

Referring now to the drawings and more particularly to FIG. 1, there is shown an imaging system 10 embodying the present invention. Imaging system 10 includes a computer 12 and an imaging device in the form of an ink jet printer 14. Computer 12 is communicatively coupled to ink jet printer 14 by way of a communications link 16. Communications link 16 may be, for example, an electrical, an optical or a network connection.

Computer 12 is typical of that known in the art, and includes a display, an input device such as a keyboard, a processor and associated memory. Resident in the memory of computer 12 is printer driver software. The printer driver software places print data and print commands in a format that can be recognized by ink jet printer 14.

Ink jet printer 14 includes a carrier system 18, a feed roll unit 20, a frame 22, a media source 24 holding a sheet of print media 26, a sensor 28 and a controller 30. Carrier system 18 includes a printhead carrier 32, a black printhead 34, a color printhead 36, guide rods 38, a carrier transport belt 42, a carrier motor 44, a driven pulley 46 and a carrier motor shaft 48. Carrier system 18 and printheads 34 and 36 may be configured for unidirectional printing or bi-directional printing.

Printhead carrier 32 is guided by the pair of guide rods 38. Guide rods 38, also known as carrier support 38, are connected to frame 22. Axes 38*a*, associated with guide rods 38, define a bi-directional printing/scanning path of printhead carrier 32. Printhead carrier 32 is slidingly connected to carrier support 38. Printhead carrier 32 is also connected to a carrier transport belt 42 that is driven by carrier motor 44 by way of driven pulley 46.

Controller 30 includes, for example, a processor and associated memory for executing process steps to control the operation of ink jet printer 14. At a directive of controller 30, printhead carrier 32 is transported in a reciprocating manner, along guide rods 38. Carrier motor 44 can be, for example, a direct current drive or a stepper motor.

The reciprocation of printhead carrier 32 transports ink jet printheads 34 and 36 across the sheet of print media 26 along a bi-directional path 38*a*. This reciprocation occurs in a direction that is parallel with bi-directional printing/scanning path 38*a* and is also commonly referred to as the main scan, or horizontal, direction. At the direction of controller 30, the sheet of print media 26 is fed by feed roll unit 20, including feed roller 40, in an indexed manner under ink jet printheads 34 and 36.

Figure 2:
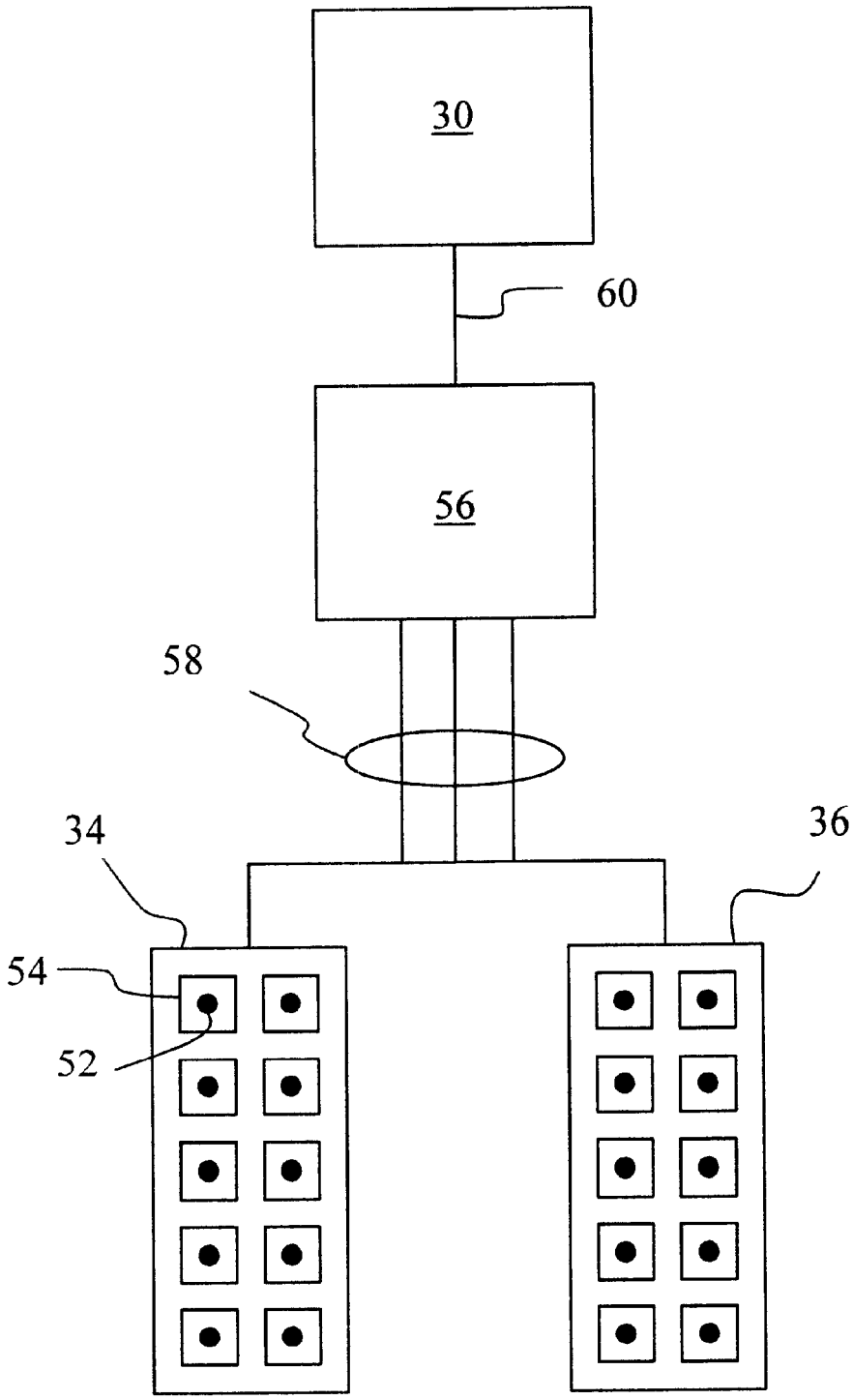
FIG. 2 is a diagrammatic representation of circuitry for supplying energy pulses to the heater elements of the printheads of FIG. 1.

Additionally referring to FIG. 2, printheads 34 and 36 each have a plurality of individually selectable nozzles 52, represented by dots, for effecting the controllable ejection of ink toward the sheet of print media 26. Associated with each nozzle is an actuator, such as heater element 54, represented by a square. Controller 30 is connected to a printhead driver 56 via communication link 60. Printhead driver 56 is connected to heater elements 54 of printheads 34, 36 via a printhead cable 58. Thus, controller 30 is controllably coupled to printheads 34 and 36 to thereby control the fire energy supplied to each heater element 54.

Also attached to printhead carrier 32 is sensor 28. Sensor 28 may be for example an optical sensor that includes a light emitter and a light detector. Light emitted by sensor 28 is reflected off of the sheet of print media 26 and is received by the light detector of sensor 28. Thus, sensor 28 can provide information to controller 30 relating to the location and quality of the printing effected by printheads 34 and 36. In an exemplary embodiment, sensor 28 can be used to align printheads 34 and 36.

Feed roll unit 20 advances the sheet of print media 26 through ink jet printer 14 via rotation of feed roller 40. Feed roll unit 20 is controllably linked to controller 30. Media source 24 is connected to frame 22 and is configured and arranged to supply individual sheets of print media 26 to feed roll unit 20, which in turn transports the sheets of print media 26 during a printing operation.

Controller 30 is linked to carrier motor 44 by way of a communications link 50. Controller 30 controls the speed direction and acceleration of carrier transport belt 42, which thereby controls the direction speed and acceleration of printhead carrier 32. Controller 30 is communicatively linked with black printhead 34 and color printhead 36 by way of communications link 60. Controller 30 selectively actuates one or more of heater elements 54 of printheads 34 and/or 36 by way of communications link 60 to effect the printing of an image on the sheet of print media 26.

Controller 30 is connected with feed roll unit 20 by way of communications link 62 thereby passing commands for controlling the feeding of the sheet of print media 26 through ink jet printer 14. Controller 30 is also communicatively coupled to sensor 28 by way of communications link 64. Information from sensor 28 is passed by way of communications link 64 to controller 30.

The fluidic properties of the ink in printheads 34 and 36 play a role in print quality and throughput. The maximum frequency at which printheads 34 and 36 can eject an ink drop from each of nozzles 52 is primarily determined by how quickly an ink chamber (not shown) can refill. The refill time is related to the force of nucleation.

By over-driving some heater elements 54 and ejecting too much ink, the ink chamber cannot refill quickly enough to print at a given frequency. This means that either the printhead will not eject a drop of ink or that it will eject a drop of the incorrect mass, both of which decrease print quality. By minimizing the nucleation force, thereby minimizing refill time, print quality improves. Minimizing the refill time also increases the frequency at which printheads 34 or 36 can operate, allowing printhead carrier 32 to travel at an increased velocity, thereby, advantageously, raising throughput.

"Fire energy" refers to the total amount of energy (in joules, for example) supplied by an energy distribution signal to an actuator, such as heater element 54, to jet a drop of ink. Fire energy can be adjusted, for example, by adjusting a duration of a pre-fire and/or a fire pulse of an energy distribution signal supplied to heater element 54. A pulse of brief duration supplies less total energy to a heater element than a lengthier pulse duration. A printhead according to one embodiment of the present invention strives to optimize a relationship between drop velocity and fire energy by using a pulse duration(s) that attains a suitable drop velocity with a minimal amount of energy.

The mechanisms behind the velocity/energy response relate to the dynamics of bubble formation and expansion. As a bubble forms in printhead 34 or 36, the bubble wall expands outward extremely quickly. The bubble itself is filled with a thermally insulating water vapor. This vapor separates and isolates the bubble wall from the heater element 54 nearly instantaneously.

Because of this condition, additional energy supplied to the heater after the onset of nucleation has little or no effect on expansion of the bubble wall. It is the rate of expansion of the bubble wall that provides the pressure pulse that ejects ink from the respective nozzle of printhead 34 or 36. The magnitude of the pressure pulse determines the ink drop velocity. Energy supplied to heater element 54 after nucleation is merely dissipated as heat and serves to degrade the performance of printhead 34 or 36.

By varying the duration of a fire pulse and/or a pre-fire pulse, for example, and measuring the corresponding drop velocity attained, a point where adding additional energy provides only marginal (or no) changes in drop velocity can be determined. Once this point is determined, an optimal duration (e.g., a duration closest to this point) can be selected for use with the printhead in future printing, thereby optimizing the relationship between fire energy and drop velocity.

Figure 3:
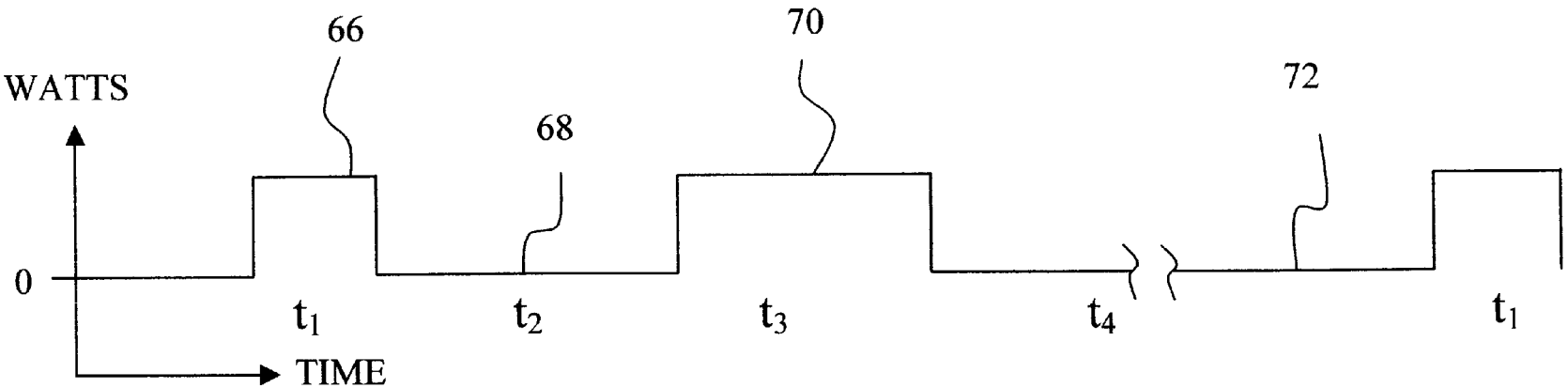
FIG. 3 depicts pulse widths associated with fire energy of the ink jet printer of FIG. 1.

Referring to FIG. 3, there is shown an exemplary energy profile for an energy distribution signal including a pre-fire pulse 66, a delay 68, a fire pulse 70, and a recharge time 72 that is supplied to heater element 54 to eject ink from a respective nozzle. The time interval of pre-fire pulse 66 has a duration $t_1$. In a similar manner the durations of delay 68, fire pulse 70 and recharge time 72 are, respectively, $t_2$, $t_3$ and $t_4$. The amplitude of pulses 66 and 70 are each typically fixed but are not necessarily equal.

The fire energy consists of the total energy of pre-fire pulse 66 and fire pulse 70. Pre-fire duration $t_1$, delay duration $t_2$, fire pulse duration $t_3$, and recharge duration $t_4$ can be varied and adjusted to optimize the drop velocity (e.g., maximize it), and to minimize the amount of energy expended through pulses 66 and 70. In one embodiment, pulse durations $t_1$ and $t_3$ can be varied to minimize energy consumption. For example, pre-fire duration $t_1$, delay duration $t_2$ and fire pulse duration $t_3$ can be incrementally varied using, for example, predetermined values to optimize a relationship between drop velocity and fire energy.

Figure 4A:
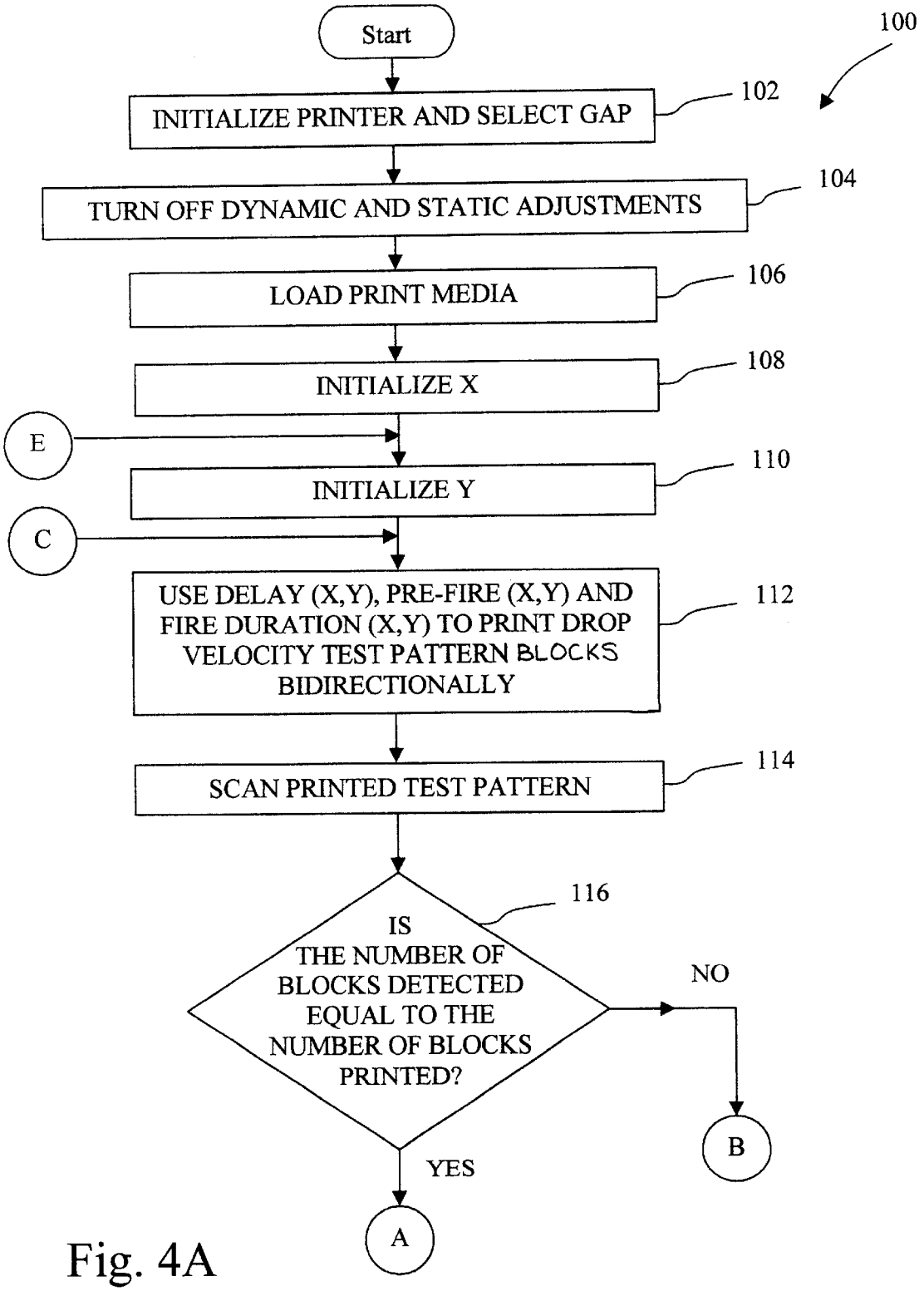
FIGS. 4A, 4B and 4C represent a flowchart of a method employed by the ink jet printer of the imaging system of FIG. 1.
Figure 4B:
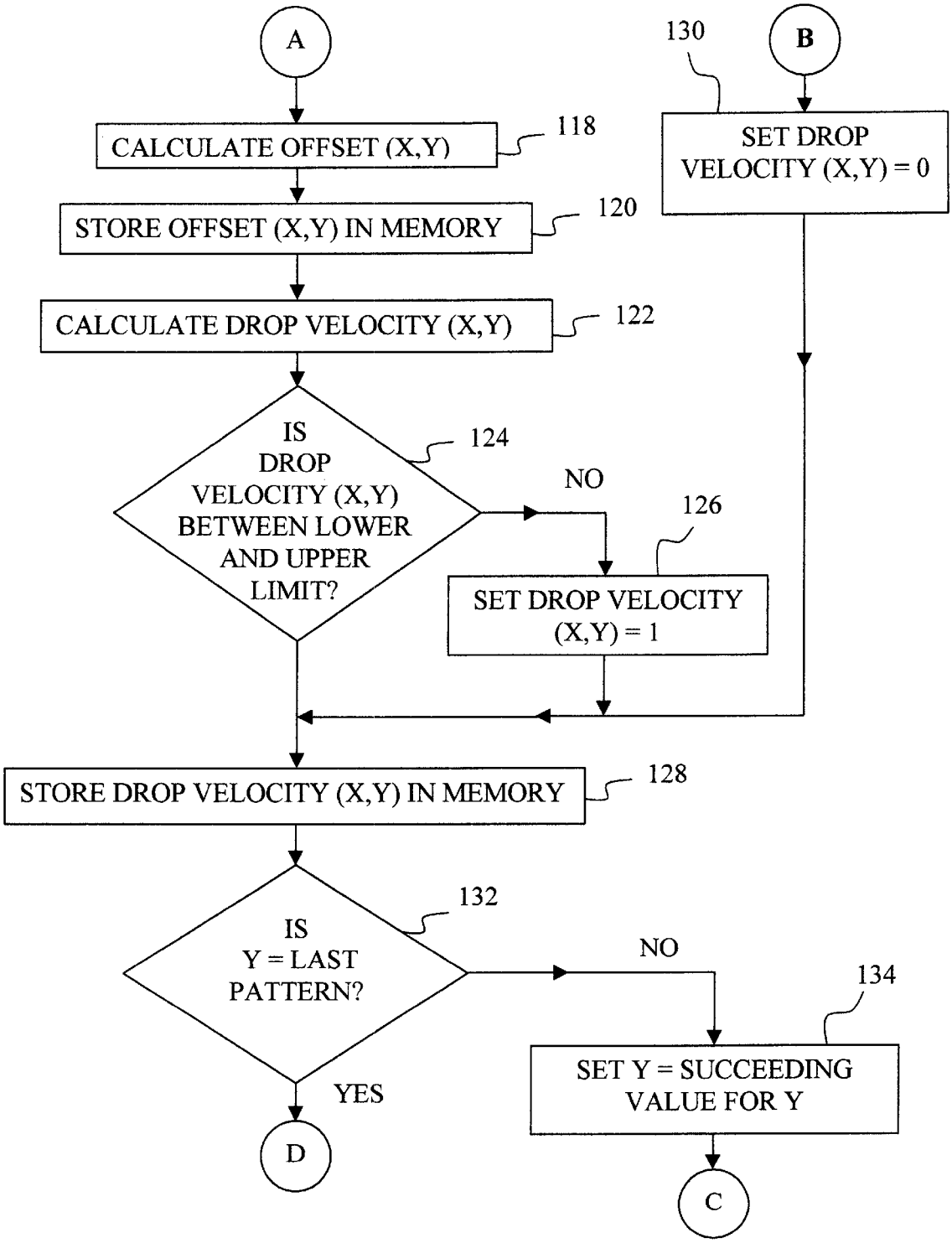
Figure 4C:
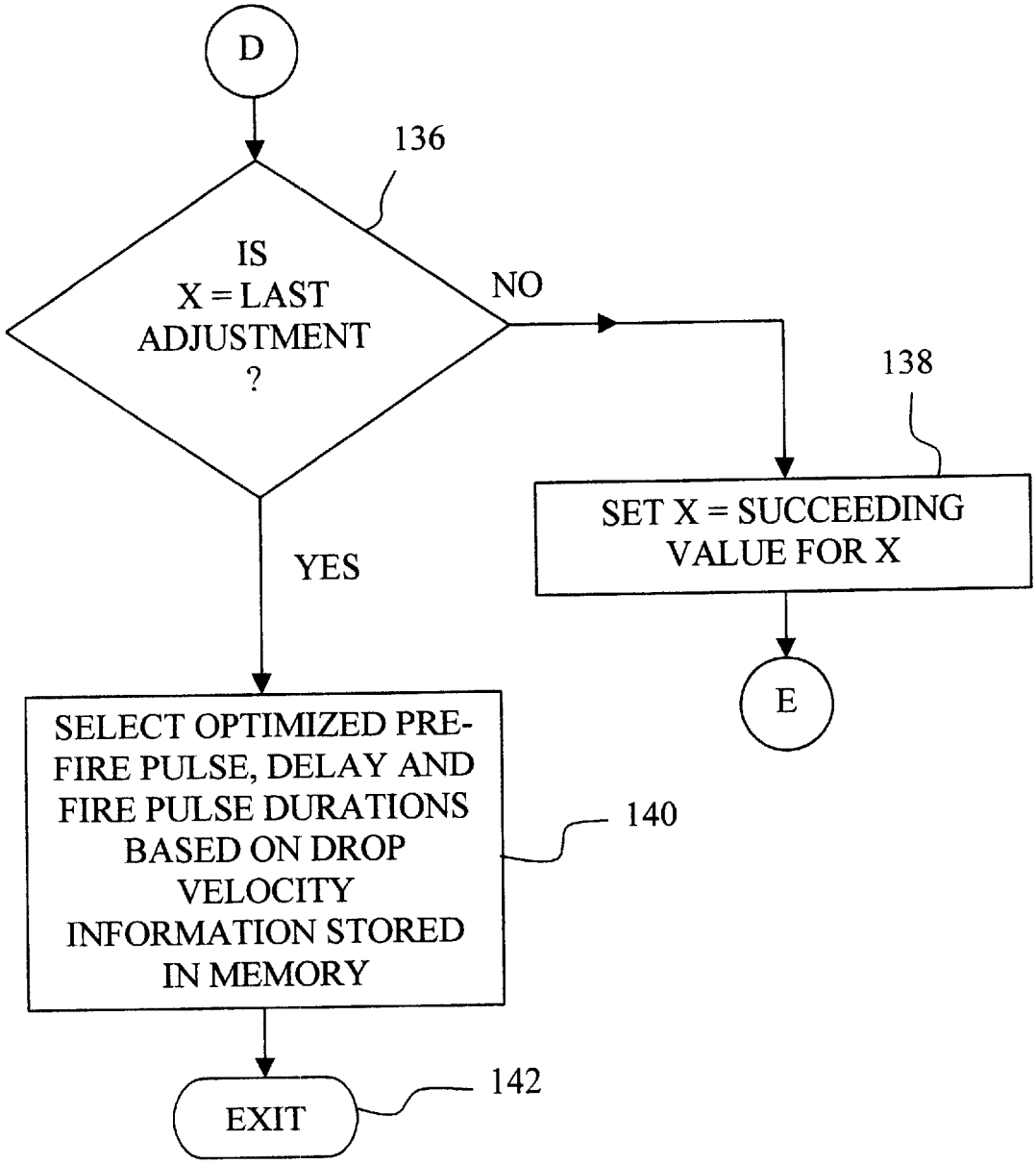

Referring to FIGS. 4A, 4B and 4C there is shown a block diagram representing a method according to one embodiment of the present invention used to determine an optimal energy distribution signal having an energy profile including pre-fire duration $t_1$, delay duration $t_2$ and pulse fire duration $t_3$. The method of FIGS. 4A–4C is depicted by a plurality of processing steps, hereinafter referred to as process 100, which may be executed by controller 30. Alternatively, process 100 can be executed by computer 12 as it interacts with ink jet printer 14.

Process 100 can be utilized to optimize, for example, pre-fire duration $t_1$, delay duration $t_2$ and pulse fire duration $t_3$ for printheads 34 and/or 36, and durations $t_1$, $t_2$ and $t_3$ may differ as between printhead 34 and printhead 36. Process 100 may be initiated each time one of printhead 34 or 36 is changed. Also, process 100 may be periodically initiated to re-optimize a relationship between drop velocity and fire energy for printheads 34 and/or 36. Process 100 will be described hereinafter with respect to printhead 36.

At step 102, ink jet printer 14 is initialized and printhead gap G relating to the printhead of interest is determined. Printhead gap G represents the distance from, for example, the sheet of print media 26 to the surface of color printhead 36. As described later herein, gap G can be used to help determine drop velocity.

Printhead gap G may be fixed. Alternatively, gap G may be adjustable, and selected by an operator. In one embodiment of the present invention, a gap G can be predetermined for a particular combination of printer and printhead.

At step 104, controller 30 turns off dynamic and static adjustments relative to printhead 36, thereby allowing a test pattern to be printed on the sheet of print media 26 without any of the static or dynamic compensations, which are stored by controller 30. Alternatively, controller 30 can account for the adjustments and compensate therefor. At step 106, controller 30 issues a command to feed roll unit 20 causing it to feed a sheet of print media 26 into ink jet printer 14.

At step 108, controller 30 initializes a variable X to an initial value, where X might represent a type of adjustment that is being incremented (e.g., a black pre-fire pulse, a black fire pulse, a color pre-fire pulse or a color fire pulse). Typically, a pre-fire pulse will be adjusted prior to adjusting a corresponding fire pulse. Step 110, similar to step 108, initializes a variable Y, where Y might represent a specific increment (e.g., in energy). For example, Y might represent pulse duration increments of about 50–75 ns. Each increment of Y can relate to a particular portion of a test pattern to be printed on a sheet of print media for a particular adjustment type X. Variable X and Y are used as control variables to control looping of process 100.

At step 112, controller 30 prints at least part of a test pattern using an energy distribution signal having an energy profile corresponding to a respective combination of variables X and Y. The energy distribution signal could be predetermined or might be generated as part of an algorithm. As each of the various combinations of X and Y variables are indexed (as further described below), a different energy distribution signal with a distinct energy profile is used to print at least a portion of a test pattern.

According to one embodiment of the present invention, only energy distribution signals that will eject ink regardless of manufacturing variability of the printhead are used (e.g., for the sake of error checking data that will be acquired). Moreover, according to an exemplary embodiment of the invention, the printhead is ran at less that its maximum frequency (e.g., a constant frequency) when printing the test pattern.

Figure 5:
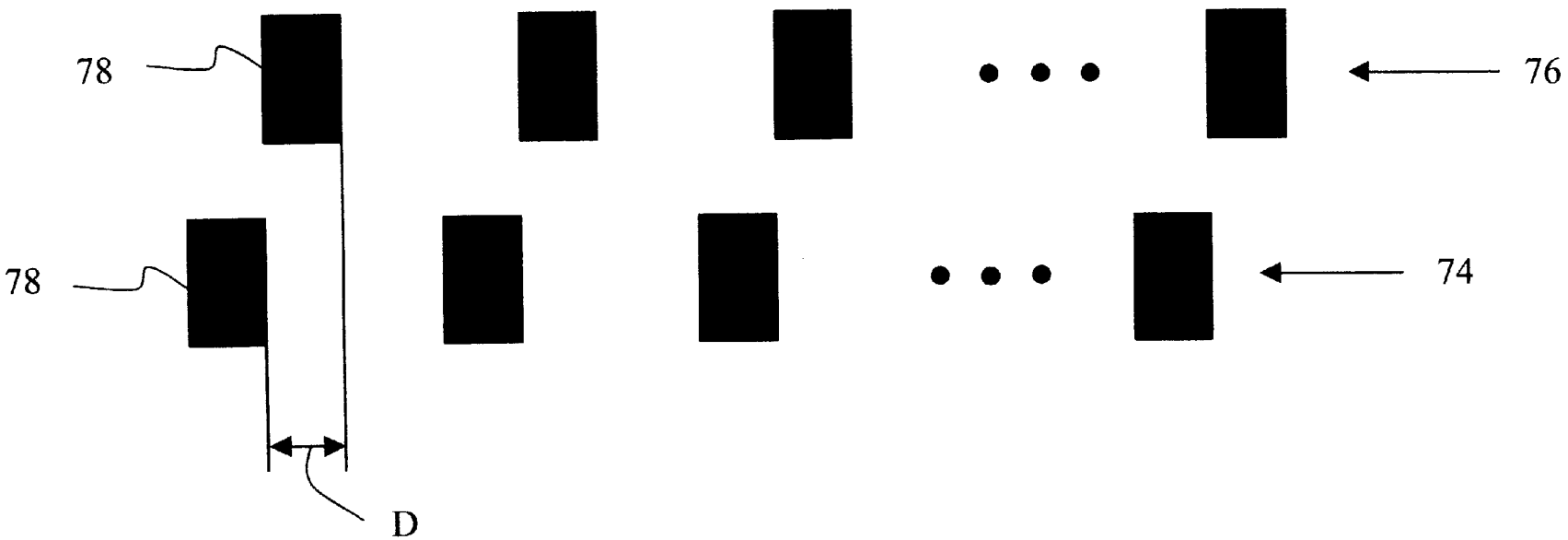
FIG. 5 depicts a test pattern printed on a print media by the ink jet printer of the imaging system of FIG. 1.

With reference to FIG. 5, there is shown an exemplary test pattern comprising a set of test subpatterns 74 and 76, each including several blocks 78. Each of blocks 78 may, for example, be a 2 mm by 4 mm rectangle. According to one embodiment of the present invention, each of blocks 78 is printed using all of the heaters that can be actuated with the signal being optimized.

First test subpattern 74 can be printed by printhead 36 in one direction as carrier 32 transports printhead 36 in a horizontal direction. Second test subpattern 76 can be printed in another direction by printhead 36 as carrier 32 transports printhead 36 in a horizontal direction opposite to the direction in which first test subpattern 74 was printed. Alternatively, test subpatterns 74 and 76 may be interleaved or in some other form, such as moiré patterns.

In one embodiment of the present invention, a respective set of test subpatterns 74 and 76 is printed using an energy distribution signal having an energy profile corresponding to a respective combination of variables X and Y. In another embodiment, a respective set of corresponding blocks 78 in a set of test subpatterns 74 and 76 is printed using an energy distribution signal having an energy profile corresponding to a respective combination of variables X and Y. One advantage of such an embodiment could include reducing the test pattern down to only one set of test subpatterns 74 and 76.

At step 114, controller 30 directs the movement of printhead carrier 32 and reads information supplied by sensor 28. The test subpatterns 74 and 76 printed on the sheet of print media 26 are scanned by sensor 28, and the information gathered is sent to controller 30. Although process 100 indicates that a set or portion of test subpatterns are scanned before a next set or portion of test subpatterns is printed, alternative embodiments of the present invention could print all or a group of such sets before scanning the same.

When test subpatterns 74 and 76 are printed, each in a different direction, an offset distance D between corresponding blocks 78 of test subpattern 74 and test subpattern 76 can be observed. Offset distance D is a measure of the shift between test subpattern 74 and test subpattern 76, which are printed in opposite directions. Offset distances D can be determined by sensor 28 detecting an attribute of blocks 78 such as the edges of corresponding blocks 78. Whereas several blocks 78 are printed, several offset distances D (also referred to herein as offset values) can be sent to controller 30 for each set of test subpatterns 74 and 76 printed.

At step 116, controller 30 determines if the number of blocks 78 detected by sensor 28 is equal to the number of blocks 78 printed by ink jet printer 14. If the number of blocks 78 detected is not equal to the number of blocks 78 printed, process 100 continues to step 130. If the number of blocks 78 detected is equal to the number of blocks 78 printed, then process 100 continues to step 118. The purpose of this test is to determine if the pattern blocks have all been printed, otherwise it is assumed that the print velocities were insufficient or caused such degradation of performance that the pulse durations (e.g., $t_1$ and $t_3$) are not appropriate for use with printhead 36.

At step 118, controller 30 calculates a value for the offset associated with the particular durations $t_1$, $t_2$ and $t_3$ that correspond to a particular combination of X and Y. At step 120, controller 30 stores the offset value for the combination of X and Y (e.g., in the controller memory).

At step 122, controller 30 calculates drop velocity for the particular X, Y values of this implementation of the loop. Drop velocity can be represented as a function of gap G, the velocity CV of printhead carrier 32 and the offset (X,Y). An exemplary equation for calculating drop velocity DV follows:

$$DV(X,Y)=(G*2CV)/(\text{Offset}(X,Y))$$

At step 124, controller 30 determines if the drop velocity associated with a particular combination of X and Y is between a lower limit and an upper limit. The lower limit being, for example, 200 inches per second and the upper limit being, for example, 700 inches per second. If the drop velocity is between the lower and upper limits, then process 100 continues to step 128, otherwise process 100 continues to step 126.

At step 126, controller 30 sets a drop velocity variable for the combination of X and Y index variables equal to the value of one. The setting of drop velocity (X,Y) equal to one is for use by controller 30, to mark the fact that drop velocity (X,Y) was outside of the prescribed limits. Following step 126, process 100 continues to step 128.

If, at step 116, the number of blocks 78 detected is not equal to the number of blocks 78 printed, at step 130, the drop velocity variable for that combination of X and Y is set to a value of zero. The setting of drop velocity (X,Y) to zero is for use by controller 30 to mark the fact that at least some of the pattern blocks 78 were not printed. Following the step 130, process 100 continues to step 128.

At step 128, controller 30 stores drop velocity (X,Y) in controller memory. Alternatively, controller 30 can store drop velocity information (e.g., drop velocity (X,Y) and/or offset (X,Y)) in a memory contained in computer 12. Process 100 then continues to step 132.

At step 132, controller 30 determines if index variable Y is equal to the last increment for a particular adjustment type X. If index variable Y is not equal to the last increment then process 100 continues to step 134. If index variable Y is equal to the last increment then process control continues to step 136.

At step 134, controller 30 sets index variable Y equal to a succeeding value for Y. Process 100 then returns to step 112.

At step 136, it has already been determined, at step 132, that Y is equal to the last increment in the index sequence. At step 136, it is determined whether index variable X is equal to the last adjustment type. If index variable X is equal to the last adjustment type, then process 100 continues to step 140. If index variable X is not equal to the last adjustment type, then, at step 138, index variable X is set to the succeeding value for index variable X, and process 100 returns to step 110.

At step 140, controller 30 determines an energy distribution signal having optimized pre-fire pulse durations $t_1$, delay durations $t_2$ and fire pulse durations $t_3$, based upon drop velocity (X,Y) information stored in memory. Drop velocities increase with an increase in fire energy to a certain point, and thereafter additional energy supplied has a marginal or no effect on drop velocity. A marginal effect is indicated when, for example, an increase in the duration of fire pulse 70, for example, does not result in a drop velocity increase substantially proportional to the increase observed between drop velocities (X,Y) reflecting preceding adjacent durations $t_3$.

For example, an optimal relationship might be determined by analyzing for the knee of a curve representing drop velocity versus fire energy (or duration). In another embodiment, as offset can be presumed to be the only variable in the aforementioned exemplary equation for determining drop velocity (e.g., gap G and carrier velocity CV can be presumed constant), offset values can be directly used, instead of their corresponding drop velocities, to determine an optimal relationship. As used herein, a "knee" of a curve can be defined as a point or area on a curve where the curvature of the curve is a maximum (or, alternatively, where the radius of curvature is a minimum). In one embodiment of the present invention, all of the measured offsets, or drop velocities determined therefrom, are considered in the determination Optimized pre-fire pulse duration $t_1$, delay duration $t_2$ and/or fire pulse duration $t_3$ may be selected from those values used to print a particular set or portion of test subpatterns 74 and 76, in step 112, or optimized durations $t_1$, $t_2$ and/or $t_3$ may be calculated based on the drop velocity (X,Y) information stored in memory. For example, if drop velocity (A,B), where A is a particular value for X and B is a particular value for Y, is less than a desired value, and drop velocity (A,D), where D is a particular value for Y and is a successor value of B, is higher than the desired value, then a duration $t_3$ may be used for fire pulse 70 which lies between the duration of the fire pulse associated with fire pulse duration (A,B) and fire pulse duration (A,D).

According to an exemplary embodiment, process 100 is used only to determine an optimal fire duration $t_3$. According to such an embodiment, pre-fire duration $t_1$ may then be determined using an algorithm that has as an input the duration of the fire pulse. For example, the pre-fire duration $t_1$ may be determined as a predetermined ratio of fire duration $t_3$, such as 3 or 4:1 (e.g., if a fire duration of 800 ns is selected, a pre-fire duration of 200 ns might be used.

If not otherwise indexed through use of the variable X, process 100 may be repeated for printhead 34. If at least one of printheads 34 or 36 are replaced, then process 100 can be reinitiated for the replaced or both printheads. Process 100 can also be initiated at timed intervals, after a certain number of characters are printed or manually by an operator, for example.

Thus, a controller can determine optimized values for durations $t_1$, $t_2$ and/or $t_3$ based upon the measured information for a particular printhead. The selection of pre-fire pulse duration $t_1$, delay duration $t_2$ and fire pulse duration $t_3$ could be made by the controller to thereby optimize a relationship between drop velocity and the fire energy associated with the printhead. This can reduce the amount of energy supplied to actuators in a particular printhead from that which would need to be supplied by a printer without the present invention. Once optimized values for pre-fire pulse duration $t_1$, delay duration $t_2$ and/or fire pulse duration $t_3$ have been selected, an ink jet printer can continue with its normal printing operations using these optimized pulse durations to selectively actuate individual ones of actuators of the printhead.

While this invention has been described with respect to one embodiment, the present invention can be further modified within the spirit and scope of this disclosure. This application is therefore intended to cover any variations, uses, or adaptations of the invention using its general principles. For example, although an exemplary embodiment was described herein with reference to an energy distribution signal having a profile that included a pre-fire and a fire pulse, the present invention is believed to be equally applicable to other energy distribution signals, such as those having a profile that includes only a single pulse. Further, this application is intended to cover such departures from the present disclosure as come within known or customary practice in the art to which this invention pertains and which fall within the limits of the appended claims.

What is claimed is:

1. A method of adjusting fire energy supplied to an actuator of a printhead of an ink jet printer, comprising:

printing a test pattern on a print media by selectively supplying energy distribution signals to a plurality of actuators of said printhead, said energy distribution signals having distinct energy profiles;

scanning said test pattern to obtain offset values, each of said offset values representative of a distance between at least two corresponding portions of said test pattern;

calculating drop velocities from said offset values; and selecting from the energy distribution signals an energy distribution signal that corresponds with an optimal one of said drop velocities.

2. The method of claim 1, wherein said selecting act comprises selecting a duration of a fire pulse of the selected one of said energy distribution signals, said fire pulse having a predetermined amplitude.

3. The method of claim 1, wherein each of said energy distribution signals comprises a pre-fire pulse and a fire pulse separated by a predetermined delay.

4. The method of claim 1, further comprising adjusting at least one of a duration of a pre-fire pulse, a delay and a fire pulse used by the printer in normal operation to substantially conform with the selected one of the energy distribution signals.

5. The method of claim 4, wherein said pre-fire pulse is adjusted using an algorithm that has as an input a duration of said fire pulse.

6. The method of claim 1, further comprising determining if said drop velocities are greater than a lower limit and less than an upper limit.

7. The method of claim 6, wherein said lower limit is 200 inches per second and said upper limit is 700 inches per second.

8. An ink jet printer, comprising:

a printhead having actuators that are capable of jetting ink with a drop velocity when an energy distribution signal having a fire energy is supplied;

a sensor; and a controller capable of communicating with the printhead and said sensor, said controller employing a method comprising:

printing a test pattern on a print media by selectively supplying energy distribution signals to a plurality of the actuators, said energy distribution signals having distinct energy profiles;

scanning said test pattern with the sensor to obtain offset values, each of said offset values representative of a distance between at least two corresponding portions of said test pattern;

calculating drop velocities from said offset values; and selecting from the energy distribution signals an energy distribution signal that corresponds with an optimal one of said drop velocities.

9. An imaging device, comprising:

a carrier;

a printhead carried by said carrier;

a sensor carried by said carrier; and a controller communicatively coupled with said printhead and said sensor, said controller configured to print an image on a sheet of print media, said image including a test pattern, said controller employing an energy distribution signal adjustment method to determine an energy profile for said printhead, wherein said energy distribution signal adjustment method includes:

printing said test pattern using distinct energy profiles;

scanning said test pattern with said sensor to obtain offset values, wherein a respective one of said offset values is representative of a distance between corresponding portions of said test pattern;

calculating drop velocities corresponding to the distinct energy profiles based on said offset values; and based on the drop velocities, determining an optimal energy profile, to determine when an incremental change in energy corresponds with a disproportionate change in drop velocity.

10. The imaging device of claim 9, wherein said determining act includes determining a duration of a fire pulse having a predetermined amplitude.

11. The imaging device of claim 9, wherein said printing act includes using energy distribution signals, each having one of the distinct energy profiles.

12. The imaging device of claim 10, wherein a duration of a pre-fire pulse is adjusted using an algorithm that has as an input said duration of said fire pulse.

13. The imaging device of claim 9, wherein said energy distribution signal adjustment method further comprises determining if said drop velocities are greater than a lower limit and less than an upper limit.

14. A method of optimizing an energy distribution signal for use by a printhead including a plurality of heater elements, comprising:

printing a test pattern using predetermined energy profiles;

scanning said test pattern to obtain offset values, wherein a respective one of said offset values is representative of a distance between corresponding portions of said test pattern;

calculating drop velocities corresponding to the energy profiles based on said offset values;

based on the drop velocities, determining an optimal energy profile, wherein the optimal energy profile is determined by using the drop velocities to determine when an incremental change in energy corresponds with a disproportionate change in drop velocity; and selecting an energy distribution signal corresponding to said optimal energy profile.

15. A method of optimizing a relationship between fire energy and drop velocity, wherein the fire energy can be supplied to an actuator of a printhead of an ink jet printer in the form of an energy distribution signal to jet ink substantially at the drop velocity, comprising:

printing a test pattern by selectively supplying energy distribution signals to a plurality of actuators of said printhead, said energy distribution signals having distinct energy profiles;

scanning said test pattern to obtain drop velocity information corresponding to the energy distribution signals; and based on the drop velocity information, determining an energy profile that optimizes the relationship between fire energy and drop velocity.

16. A method of claim 15, wherein determining an energy profile comprises selecting one of the energy distribution signals supplied in the printing act.

17. A method of claim 15, wherein determining an energy profile comprises using the drop velocity information to determine when an incremental change in energy corresponds with a disproportionate change in drop velocity.

18. A method of claim 15, wherein printing a test pattern comprises printing a respective set of test subpatterns using a respective one of the energy distribution signals for each set.

19. A method of claim 18, wherein scanning comprises scanning the test pattern to obtain an offset value for each of the sets, wherein the offset value for a respective one of the sets is representative of a distance between at least two corresponding portions in the respective one of the sets, and wherein the drop velocity information comprises drop velocities determined from the obtained offset values.

20. A method of claim 15, wherein printing a test pattern comprises printing test subpatterns, each of the subpatterns comprising blocks, each of the blocks in one of the subpatterns corresponding with a block in another one of the subpatterns, and wherein corresponding blocks are printed using a respective one of the energy distribution signals.

21. A method of claim 20, wherein scanning comprises scanning the test pattern to obtain an offset value for each set of corresponding blocks, wherein the offset value for a respective one of the sets is representative of a distance between at least two corresponding portions in the respective one of the sets, and wherein the drop velocity information comprises drop velocities determined from the obtained offset values.

22. A method of claim 15, wherein drop velocity information comprises offset values each representative of a distance between at least two corresponding portions of the test pattern.

23. A method of claim 15, wherein determining an energy profile comprises calculating an optimal duration of a pulse to be used in an energy distribution signal to be used with the printhead during normal operation, wherein the optimal duration is calculated based on the drop velocity information.

* * * * *